US011314206B2

(12) United States Patent
Mintiens

(10) Patent No.: US 11,314,206 B2
(45) Date of Patent: Apr. 26, 2022

(54) MECHANICAL CLOCKWORK

(71) Applicant: Benoît Mintiens, Lint (BE)

(72) Inventor: Benoît Mintiens, Lint (BE)

( * ) Notice: Subject to any disclaimer, the term of this patent is extended or adjusted under 35 U.S.C. 154(b) by 715 days.

(21) Appl. No.: 16/305,559

(22) PCT Filed: Mar. 23, 2017

(86) PCT No.: PCT/BE2017/000020
§ 371 (c)(1),
(2) Date: Nov. 29, 2018

(87) PCT Pub. No.: WO2017/205944
PCT Pub. Date: Dec. 7, 2017

(65) Prior Publication Data

US 2020/0326657 A1 Oct. 15, 2020

(30) Foreign Application Priority Data

Jun. 2, 2016 (BE) ..... 2016/5407

(51) Int. Cl.

| | |
|---|---|
| ***G04B 19/02*** | (2006.01) |
| ***G04B 13/02*** | (2006.01) |
| ***G04B 19/24*** | (2006.01) |
| ***G04C 3/14*** | (2006.01) |
| ***G04R 20/26*** | (2013.01) |

(52) U.S. Cl.
CPC ..... *G04B 19/02* (2013.01); *G04B 13/027* (2013.01); *G04B 19/24* (2013.01); *G04C 3/14* (2013.01); *G04R 20/26* (2013.01)

(58) Field of Classification Search
CPC ..... G04B 19/02; G04B 19/24; G04B 19/027; G04C 3/14; G04R 20/26
See application file for complete search history.

(56) References Cited

U.S. PATENT DOCUMENTS

| | | | | |
|---|---|---|---|---|
| 5,751,666 | A | 5/1998 | Farine et al. | |
| 2005/0036405 | A1* | 2/2005 | Born | G04C 11/084 368/127 |
| 2010/0128573 | A1 | 5/2010 | Meijer et al. | |
| 2015/0131413 | A1 | 5/2015 | Helfer et al. | |
| 2017/0075314 | A1* | 3/2017 | Perez-Feliciano | G04G 9/0064 |

FOREIGN PATENT DOCUMENTS

| | | | |
|---|---|---|---|
| BE | 1019110 | A5 | 3/2012 |
| CN | 202 904 231 | U | 4/2013 |
| EP | 2 874 023 | A1 | 5/2015 |
| WO | 2008/007948 | A2 | 1/2008 |

OTHER PUBLICATIONS

International Search Report and Written Opinion, dated Jun. 28, 2017, from corresponding PCT application No. PCT/BE2017/000020.

* cited by examiner

*Primary Examiner* — Sean Kayes
(74) *Attorney, Agent, or Firm* — Nixon & Vanderhye

(57) ABSTRACT

Disclosed is a clockwork with pointers or with a pointer module driven by a mechanical driving gear, wherein the clockwork is a hybrid clockwork that in addition to the mechanical driving gear, also at least includes an additional driving gear with a motor and an electric or electronic controller that is internal and which is equipped to be able to drive and/or adjust the pointers or the pointer module in parallel or in series with the mechanical driving gear.

19 Claims, 5 Drawing Sheets

MECHANICAL CLOCKWORK

The present invention relates to a mechanical clockwork.

Such a mechanical clockwork is provided with a mechanical driving gear with one or more outgoing spindles to drive pointers or a pointer module for indicating the time.

The driving gear is provided with a winding system with a spring or similar that must be regularly wound up, either manually by turning a 'crown wheel', or semi-automatically by the movements of the hand.

Mechanical clockworks are relatively expensive, especially when they are precision clockworks that must be manufactured with a very high accuracy.

A disadvantage of mechanical clockworks is that they generally have to contend with a variation, however small, that can increase over time on account of ageing, wear and similar.

A disadvantage coupled to this is that the person is never certain of the precise time and that the clockwork must be inspected now and again, and if necessary set to the actual time.

This setting always requires an external operation and an external connection to the driving gear, whereby this external connection can give rise to undesired infiltration of moisture and dust and wear.

Another disadvantage of a conventional mechanical clockwork is that when changing from summertime to wintertime and vice versa, the time must be adjusted on each occasion, likewise when travelling from one time zone to another time zone.

Another disadvantage of a conventional mechanical clockwork is that it must be wound up manually and/or automatically. If the clockwork stops, it must be set again.

Digital clockworks generally work on the basis of a quartz clock and are generally much more accurate and in principle must be set much less, except when the clockwork stops, for example as a result of a dead battery or similar.

Many people choose a mechanical clockwork on account of the image that it creates, despite the lower precision.

WO 2008/007948 A2 describes an adjustment apparatus for a mechanical watch in which the mechanical clockwork is coupled not only to a mechanical oscillator, but also to an electrical generator. A sensor compares the frequency of the mechanical oscillator to a reference signal such as a quartz oscillator or a radio signal and adjusts if necessary the frequency of the mechanical oscillator so that the indicated time is corrected. The system is suitable for continuous adjustment with small corrections so as to keep the position of the pointers in agreement with the real time.

CN 202 904 231 U describes an adjustment apparatus to adjust the orientation of the pointer. A differential coupling is used during the adjustment of the pointer in order not to influence the normal operation of the clock. The pointer can be shifted in an electrical way, but is limited to the adjustment of the pointer of seconds.

U.S. Pat. No. 5,751,666 A describes also an adjustment apparatus to adjust the speed of the pointer. The adjustment apparatus comprises an IC (integrated circuit) in which the frequency of a time base such as a quartz oscillator is compared with the mechanical drive of the mechanical clock. When the wound spring gets exhausted the ensuing error of the pointer position is immediately and the user is invited to rewind the spring. The adjustment is suitable for small corrections, but does not replace the crown of a mechanical watch with which the exact hour can be set after a period in which the watch was stopped for instance.

The purpose of the present invention is to provide a solution to the aforementioned and other disadvantages. To this end the invention concerns a pointer module for the pointers of a clockwork driven by a mechanical driving gear, whereby the clockwork is a hybrid clockwork that in addition to the mechanical driving gear, also at least comprises an additional driving gear with a motor and an electric or electronic controller that is internal and which is equipped to be able to drive and/or adjust the pointers or the pointer module in parallel or in series with the mechanical driving gear.

An advantage of such a clockwork according to the invention is that the pointers are not only driven in the conventional mechanical way, but can also be driven or adjusted by at least one additional controlled drive of the motor that can be electrical or mechanical.

This additional drive can be controlled by an internal or an external signal.

This characteristic offers many extra possibilities with respect to a conventional mechanical clockwork with mechanical pointers, for example when the electrically or electronically controlled driving gear can receive signals from a precise clock and can influence the operation of the clockwork as a function thereof, for example to automatically synchronise the indicated time with the signals originating from a precise clock.

Such signals can originate for example from an integrated internal quartz clock or from an external signal of an atomic clock transmitted by a radio mast or originating from the internet or similar.

This makes it possible to make a clockwork from a mechanical clockwork with mechanical pointers or with a mechanical pointer module with the precision of a quartz clock or an atomic clock or similar, which in practice is excluded for a conventional mechanical clockwork, not even with the most expensive and most accurate embodiments.

The pointer module according to the invention can be added a posteriori to any existing mechanical clockwork as an add-on or plug-in, in order to provide any conventional mechanical clockwork with the precision and automatic adjustment of a quartz clock or of an atomic clock.

For the precision use is made either of an external signal of an atomic clock for instance a radio signal indicating the correct time, or of an internal signal of a built-in quartz clock with a program of the correct time on the basis of this internal built-in quartz clock.

The pointer module measures the position of the pointers continuously and will set the pointers on the programmed or desired hour.

Moreover, it can automatically adapt to the transition from summertime to wintertime or adjust the time when travelling from one time zone to another, or adjust the date at the end of a month that does not have 31 days, and similar.

Moreover, it is no longer necessary to reset the time shown by the mechanical clockwork after the clockwork has stopped due to a lack of winding reserve. A clockwork according to the invention will indeed be automatically reset when it is again set in operation by rewinding it.

A pointer module according to the invention also offers the possibility to adjust the clockwork via the additional driving gear via a wireless connection, for example via Bluetooth by means of a smartphone, PC or similar.

An additional advantage is that no external mechanical operation is needed to set the clockwork, which can create problems with regard to waterproofing and dust proofing, the number one enemy of a mechanical clockwork. The pointer module replaces de facto the adjustment function of the crown of any mechanical clockwork, that is equipped with it.

With the intention of better showing the characteristics of the invention, a few preferred embodiments of a hybrid clockwork according to the invention are described hereinafter by way of an example without any limiting nature, with reference to the accompanying drawings wherein:

FIG. 1 schematically shows the mechanism of a hybrid clockwork according to the invention with two driving gears;

Figure 1:
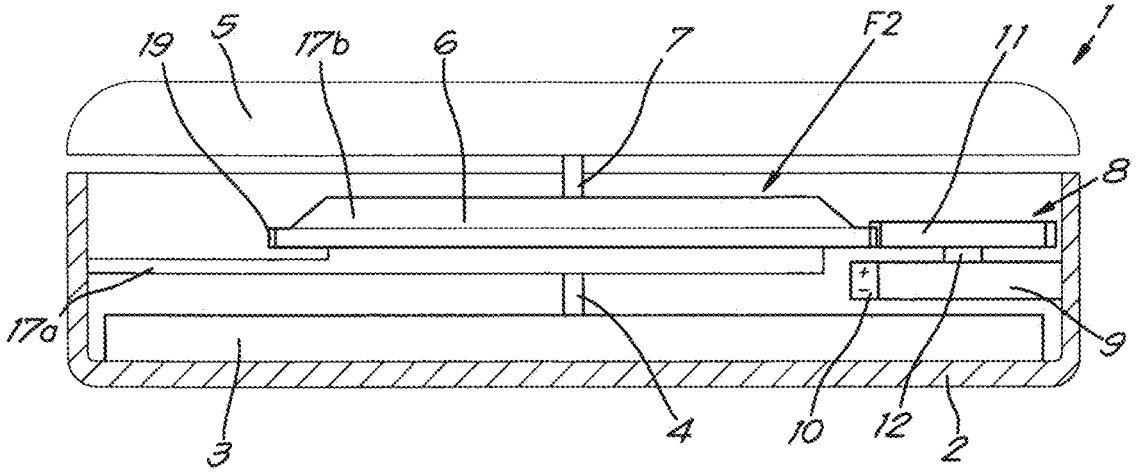

The clockwork 1 in the form of a wristwatch of FIG. 1 comprises a housing 2; a conventional mechanical driving gear 3 that is fastened in the housing and which for example is driven by the impetus of a wound-up spring and which in this case is provided with an outgoing rotating spindle 4 for driving a pointer module 5 with mechanical pointers via a differential 6 that is fastened in the housing 2 and which is driven directly by the aforementioned outgoing spindle 4 of the mechanical driving gear 3, and which is provided with an outgoing spindle 7 for the direct drive of the pointer module 5.

An example of a pointer module 5 can be illustrated on the basis of FIGS. 7 and 8, which will be discussed further.

In addition to the mechanical driving gear 3 the clockwork 1 is also equipped with an additional driving gear 8 with a motor 9 that is an electric motor in the example shown, for example a stepper motor, that is incorporated internally in the housing 2 and is fastened therein, and which for example is supplied by a battery 10 or similar.

The driving gear 8 is further provided with a drive gear 11 that is fastened to the spindle 12 of the motor 9 and which is permanently coupled to the aforementioned differential 6 to be able to drive the outgoing spindle 7 of the differential 6 via this differential 6, and this in parallel to and independently of the mechanical driving gear 3.

Figure 2:
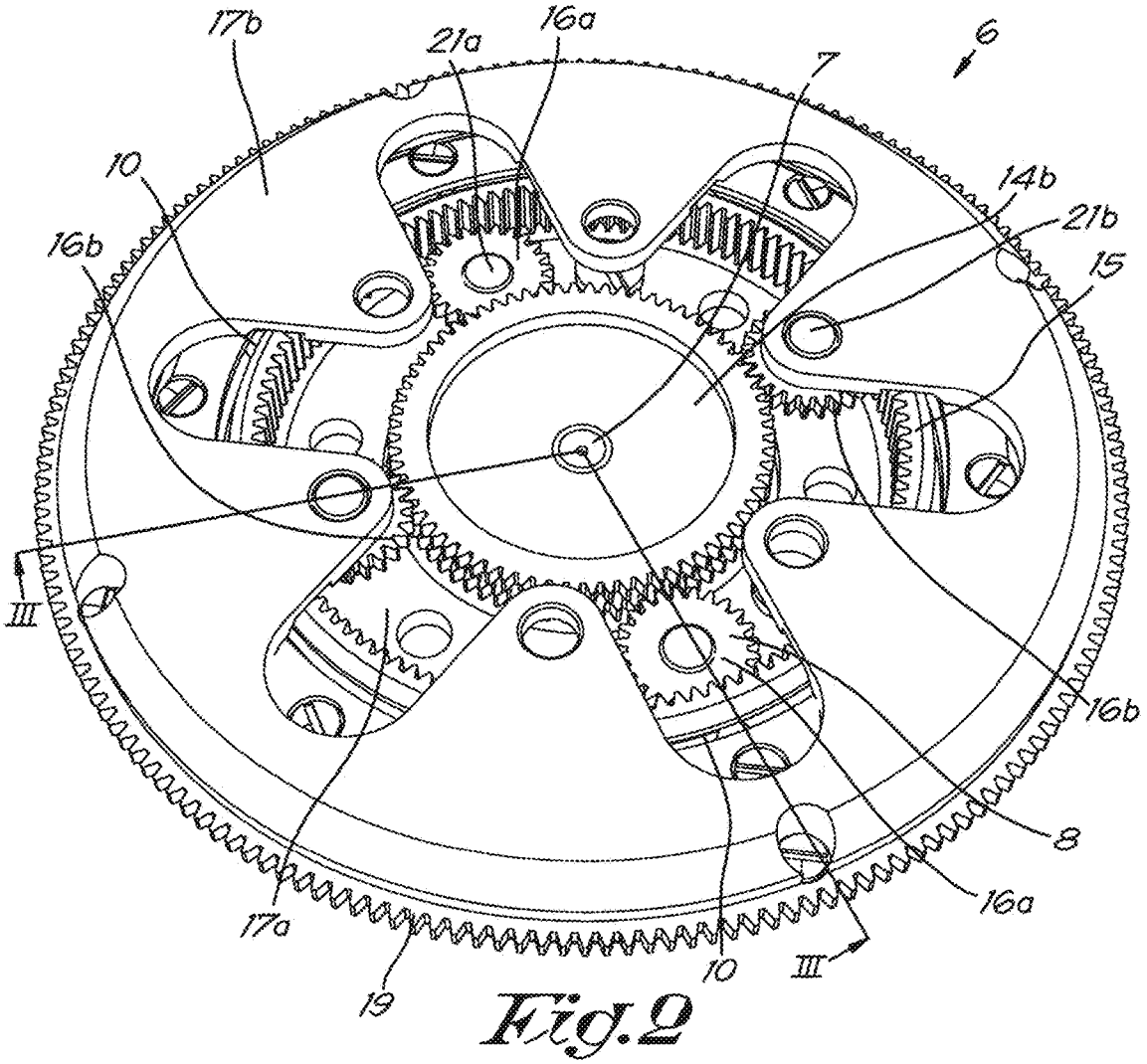
FIG. 2 shows a perspective view on a larger scale of the differential that is indicated by F2 in FIG. 1.
Figure 3:
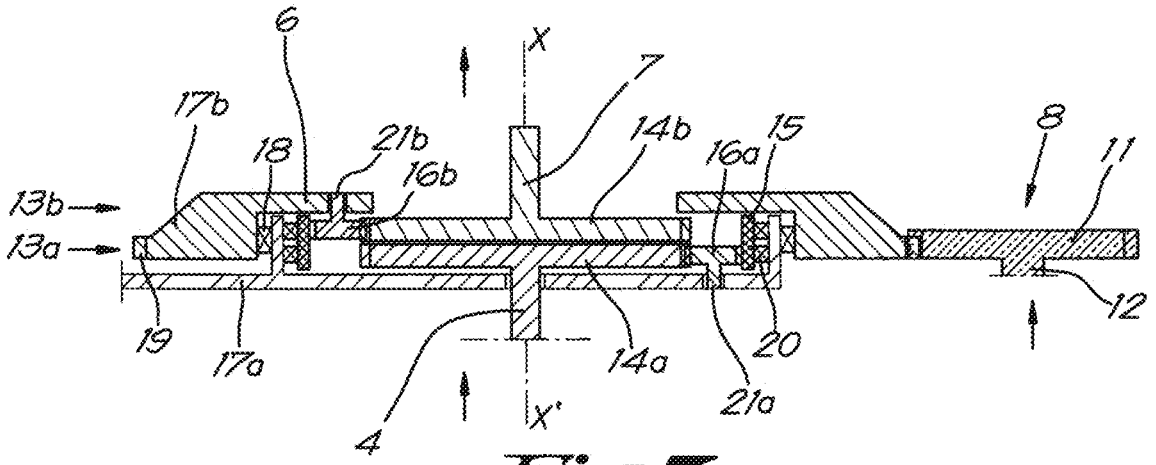
FIG. 3 shows a cross-section according to line III-III of FIG. 2.

As shown in more detail in the example of FIGS. 2 and 3, the differential 6 is formed by two coaxial planetary gear transmissions positioned above one another, respectively a first gear transmission 13*a* and a second gear transmission 13*b*, each composed of a sun gear 14*a* and 14*b* respectively, a coaxial crown wheel 15 that is common to both planetary gear transmissions 13, and two satellites 16*a* and 16*b* respectively engaging in between for each gear transmission 13, that are rotatably mounted on bearings on or in a satellite support 17*a* and 17*b* respectively.

The satellite support 17*a* has a fixed connection to the housing 2 of the clockwork 1 while the satellite support 17*b* is rotatably affixed around the fixed satellite support 17*a* by means of a bearing 18.

The rotatable satellite support 17*b* is provided along its outer periphery with an external toothing 19 that can mesh with the gear 11 of the additional driving gear 8 to transfer torque.

The fixed satellite support 17*a* is also a support of the common crown wheel 15 that is freely rotatably mounted on bearings 20.

The satellites 16*a* and 16*b* are rotatably mounted by their shafts 21*a* and 21*b* on bearings in their respective satellite supports 17*a* and 17*b*.

The sun gear 14*a* of the first planetary gear transmission 13*a* is directly coupled to the outgoing spindle 4 of the mechanical driving gear 3, while the sun gear 14*b* of the second planetary gear transmission 13*b* is directly coupled to the outgoing spindle 7 of the differential 6.

The operation of this differential 6 enables the outgoing spindle to be driven independently by each of the driving gears 3 and 8, either separately from one another or together so that their influences on the movement of the outgoing spindle 7 are added together or that these influences entirely or partially counteract or eliminate one another, with this depending on the direction in which the driving gears 3 and 8 are driven.

The independent operation of the differential can be explained in the following way on the basis of FIGS. 2 and 3.

On the assumption that only the mechanical driving gear 3 is driven and the additional driving gear is not driven and thus the gear 11 and the satellite support 17*b* have a fixed position, the transfer of the torque of the outgoing spindle 4 of the mechanical driving gear to the outgoing spindle 4 of the differential proceeds in the following way:

- the outgoing spindle 4 and the sun gear 14*a* fastened thereto enables the satellites 16*a* to rotate around their fixed shafts 21*a;*
- because the shafts 21*a* are fixed, the freely rotating common crown 15 is driven in rotation around its axis X-X';
- the common crown 15 in turn drives the satellites 16*b* around their shafts 21*b* that are held in a fixed position by the satellite support 17*b;*
- due to the rotation of the satellites 16*b* around their fixed shafts 21*b*, the sun gear 14*b* is driven and as a result also the outgoing spindle 7 to the pointer module 5.

The differential can be designed such that in this case the outgoing spindle 7 of the differential 6 rotates at the same speed and in the same direction as the outgoing spindle 4 of the mechanical driving gear 3 and consequently both spindles 4 and 7 turn synchronously.

On the other assumption that only the additional driving gear 8 is driven and the mechanical driving gear 3 is kept stationary, then the following situation arises:

- because the sun gear 14*a* and the satellite support 17*a* are fixed, the satellites 16*a* are also fixed and as a result also the common crown wheel 15;
- by driving the additional driving gear 8 the satellite support 17 is now driven in rotation around its axis X-X';
- because the common crown wheel 15 is fixed, as a result the sun gear 14*b* together with the outgoing spindle 7 of the differential 6 are driven to drive the pointer module 5 in this way.

It is thus clear that both driving gears 3 and 8 can drive the pointer module 5 independently from one another.

When both driving gears 3 and 8 are driven together, then, depending on the direction of rotation in which and the speed at which the additional driving gear 8 is driven, the outgoing spindle 7 of the differential 6 will turn faster or more slowly than the outgoing spindle 4 of the mechanical driving gear.

Figure 4:
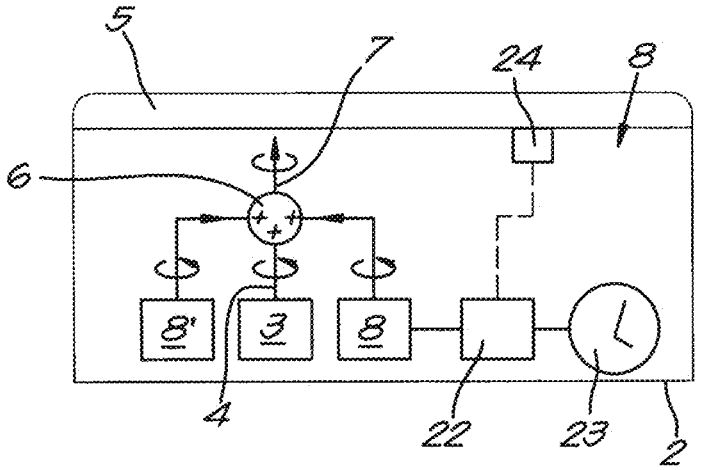
FIGS. 4 and 5 show a diagram of two variant embodiments of a clockwork according to FIG. 1 with three driving gears in parallel.

This comes down to a system of parallel driving gears as schematically shown in FIG. 4 in which, in addition to the mechanical driving gear 3 and the additional driving gear 8, a second additional driving gear 8' is also connected in parallel.

This thus enables the pointers or pointer module to turn more quickly or more slowly to thus correct the indicated time if necessary.

As schematically shown in FIG. 4, the clockwork can be provided with an electric or electronic controller 22 for controlling the additional driving gear 8 as a function of the signal originating from a precise internal clock 23, for example a quartz clock 23.

In the controller 22 for the additional driving gear 8 an algorithm is provided that records the indicated time continuously or periodically, for example with a sensor 24, and compares it to the time data received from the internal clock 23, and, if there is a time difference between the two, adjusts the indicated time by driving the additional driving gear 8 in the one or the other direction to make the indicated time in the pointer module 5 correspond to the time data received from the internal clock 23. In this way a hybrid clockwork 1 can be realised with the precision of a quartz clockwork.

It is not excluded that the driving gear 3 and the additional driving gear 8 form one single unit, or in other words that the additional driving gear 8 is incorporated in the driving gear 3.

Figure 5:
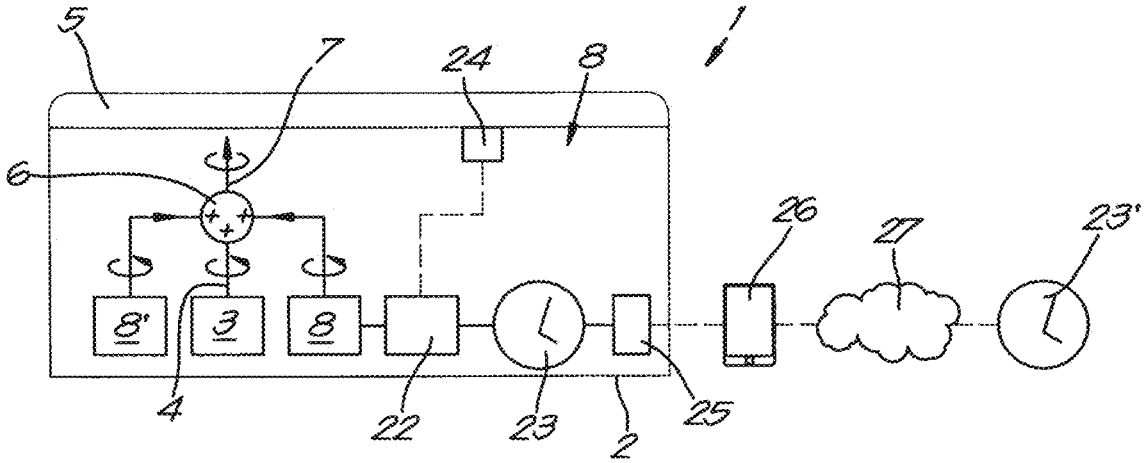

FIG. 5 shows a variant embodiment of a hybrid clockwork 1 according to the invention that is additionally provided with a receiver 25 with respect to the clockwork of FIG. 4 to pick up wireless signals, for example from an external clock 23, for example via a Bluetooth connection to a smartphone 26, PC or similar, that can be connected to the internet 27 to collect such signals from the internet, whereby the external clock 23' can be a very precise atomic clock for example.

The receiver 25 is provided thereon to adjust the internal quartz clock 23 if necessary as a function of the external signal from the external clock 23'. In this way a hybrid clockwork 1 can be obtained with the precision of an atomic clock.

It is not excluded that the internal clock 23 is omitted and that the receiver 25 is directly connected to the controller 22 to control the additional clockwork 8.

The receiver 25 also makes it possible, for example, to control the clockwork 1 in order to adjust the time by means of a smartphone application or as a function of the location data of the smartphone 26 to adjust the time to the time zone, and similar.

The motor 9 of the additional driving gear 8 does not necessarily have to be an electric motor, but can also be a mechanical drive that is driven by means of a spring or similar. This mechanical drive can vary its speed of rotation by means of an electronic controller.

The invention also applies to a mechanical clockwork with a mechanical driving gear with more than one outgoing spindle, for example one for the hours and one for the minutes, whereby for example a differential can be applied to each or at least a part of these outgoing spindles.

Figure 6:
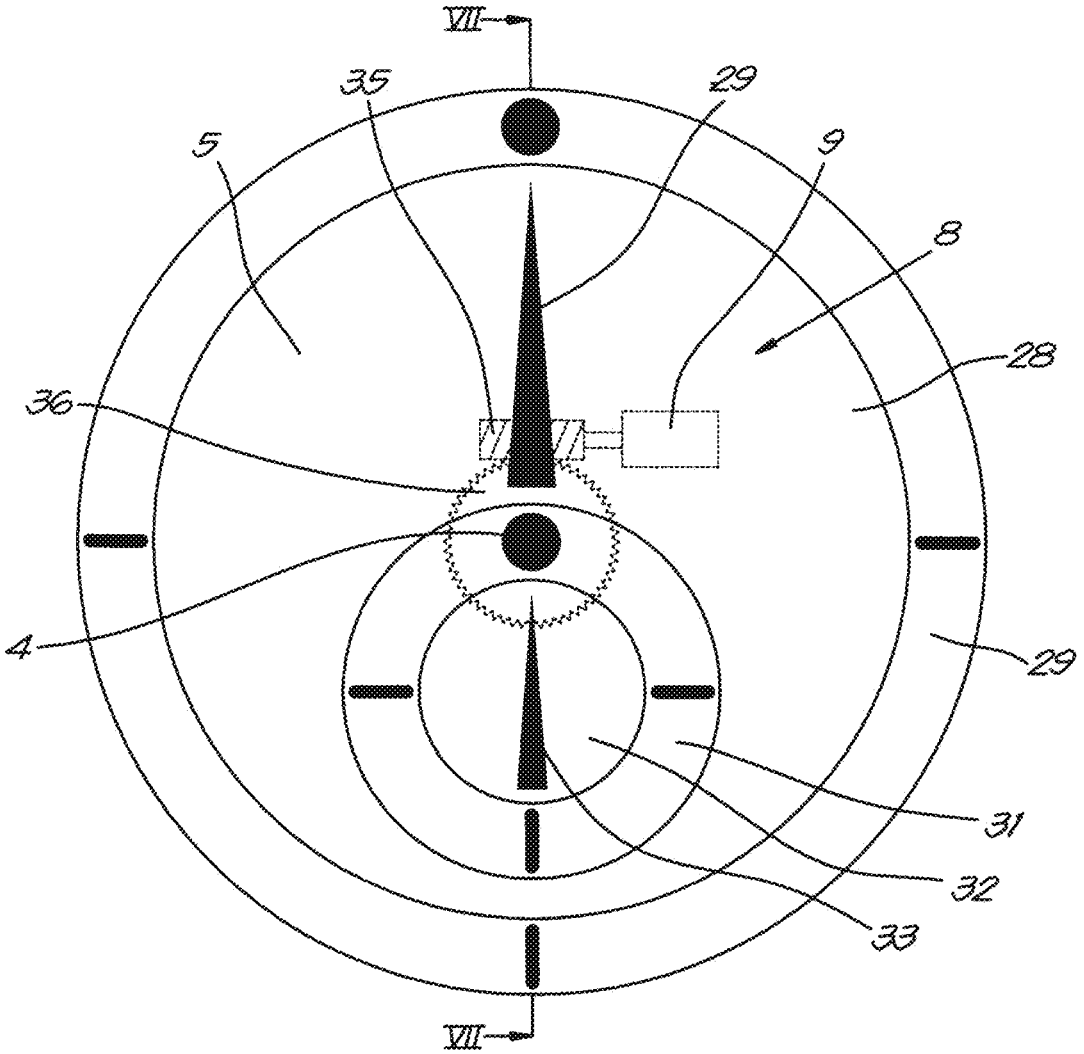
FIG. 6 shows a top view of a pointer module of the clockwork according to the invention.

FIG. 6 shows a pointer module 5 that can be driven by a single spindle 4 of a mechanical driving gear 3. Such a pointer module is for example described in the Belgian patent BE101911 of the present inventor, the description of which is hereby incorporated by reference.

This pointer module 5 comprises a pointer plate in the form of a minute disk 28 with a minute pointer 29 that is driven in rotation with respect to a fixed minute scale 30 by the outgoing spindle 4 of the mechanical driving gear 3.

In a recess of the disk 28 a ring-shaped hour scale 31 is rotatably affixed with a rotatable hour disk 32 with an hour pointer 33 therein.

Figure 7:
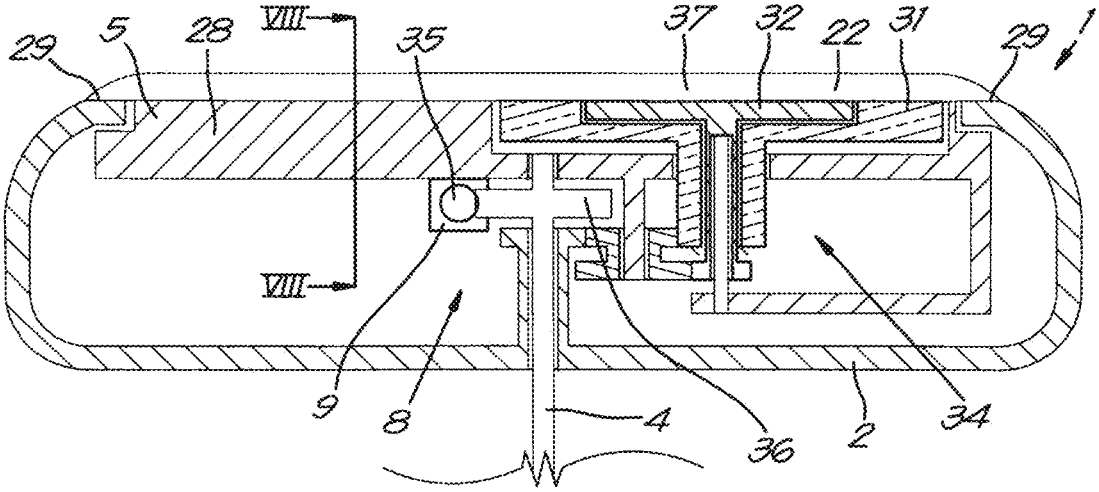
FIG. 7 shows a cross-section according to line VII-VII of FIG. 6.
Figure 8:
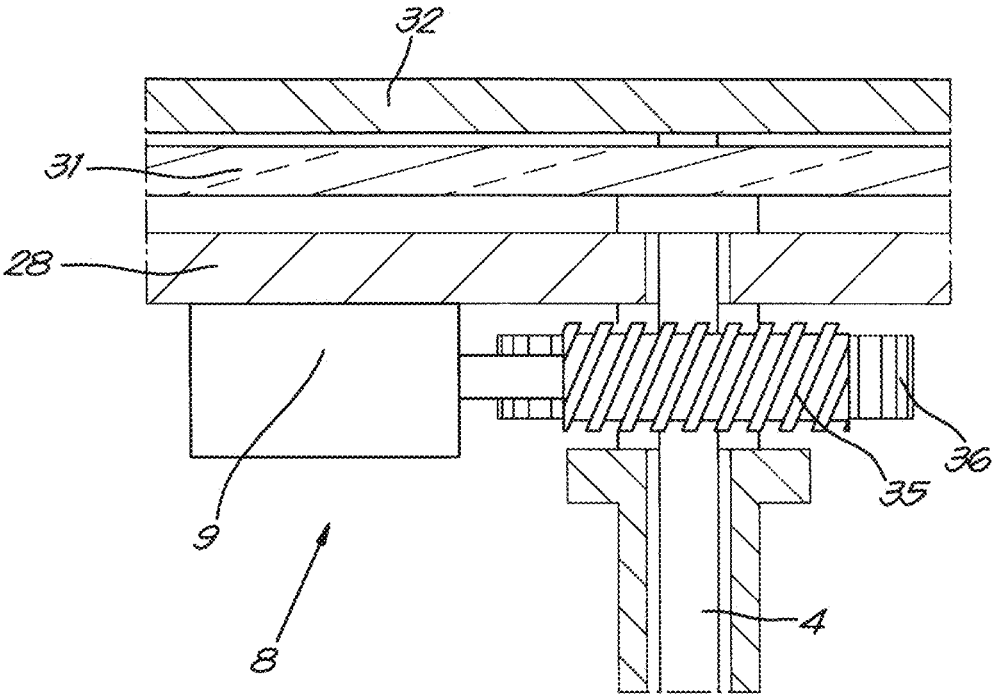
FIG. 8 shows a cross-section according to line VIII-VIII of FIG. 7.

A gear system 34 as illustrated in FIG. 7 and as explained in BE101911 ensures that the turning movement of the minute disk 28, the hour scale 31 and the hour disk are driven at a suitable speed to be able to read off the time.

It is specific to the invention that in this case, in contrast to BE101911, the minute disk 28 is not directly driven by the outgoing spindle 4 of the mechanical driving gear 3, but is indirectly driven via an additional driving gear 8 as shown by the dashed line in FIG. 6 and as shown in FIGS. 6 and 7.

In this case the minute disk 28 is freely rotatably affixed on the outgoing spindle 4 of the mechanical driving gear 3 and the additional driving gear 8 is formed by an electric stepper motor that is fastened to the minute disk 28, and which is provided on its spindle with a worm 38 that meshes with a worm wheel 36 engaging therewith that is fastened to the outgoing spindle 4 of the mechanical driving gear 3.

If the additional driving gear 8 is not driven, then the minute disk 28 turns jointly and synchronously with the outgoing spindle 4 of the mechanical driving gear so that in this case the situation is the same as when the minute disk 28 is driven directly by the mechanical driving gear.

However, when the indicated time is ahead or behind the actual time, then the clockwork 1 can be adjusted by driving the worm 35 with the motor 9 in the one or the other direction, such that the minute disk 28 can be turned with respect to the outgoing spindle 4 to correct the indicated time.

Figure 9:
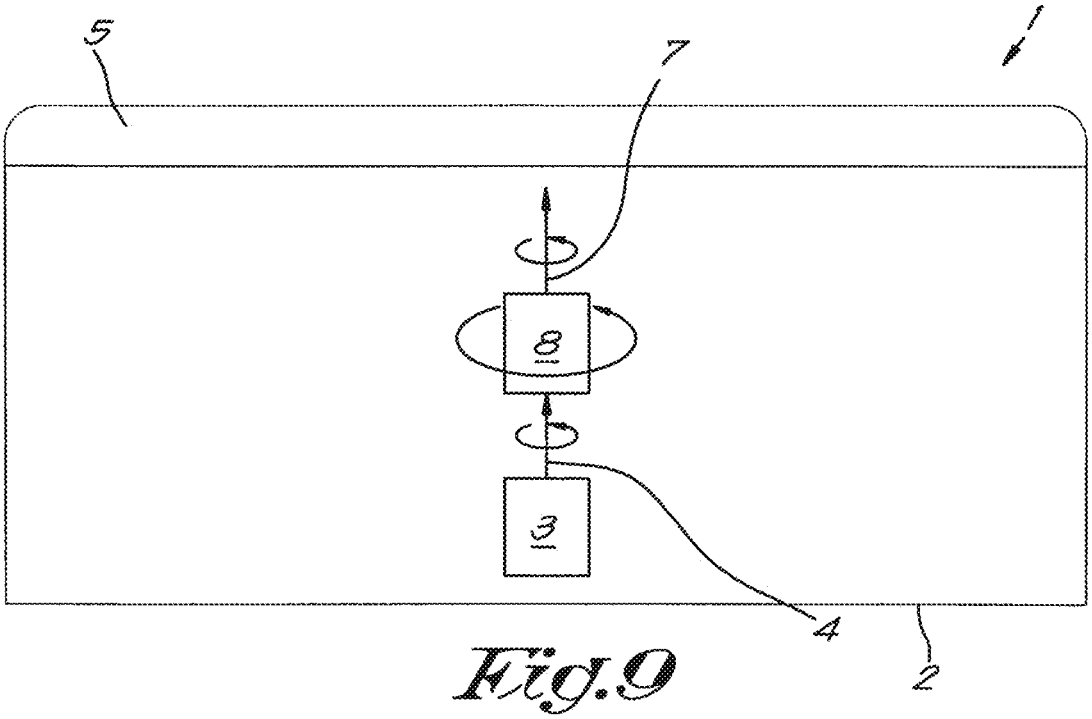
FIG. 9 shows another variant of a hybrid clockwork according to the invention with two driving gears in series.

In fact this comes down to the fact that in this case the mechanical driving gear and the additional driving gear 8 engage in series, as schematically shown in FIG. 9.

The electric motor 9 can itself be provided with a battery that turns with the minute disk 28, or can obtain its power from a battery or another supply that is fastened in the housing 2, in which case slip rings must be provided to transmit the power from the fixed battery to the motor 9 on the rotatable minute disk 28.

According to a specific aspect of the invention, for the receiver 22 for the control of the additional driving gear, use can also be made of a transparent touchscreen 37, which, as shown in 7, covers the pointers as a watch glass according to certain touch movements to be able to adjust the indicated time.

It is clear that the touch screen 37 can also be an interactive touchscreen on which symbols or similar can be temporarily or permanently displayed. The touchscreen 37 can also be used to operate or set other functions of the clockwork 1 such as the date, a chronograph function or similar.

Figure 10:
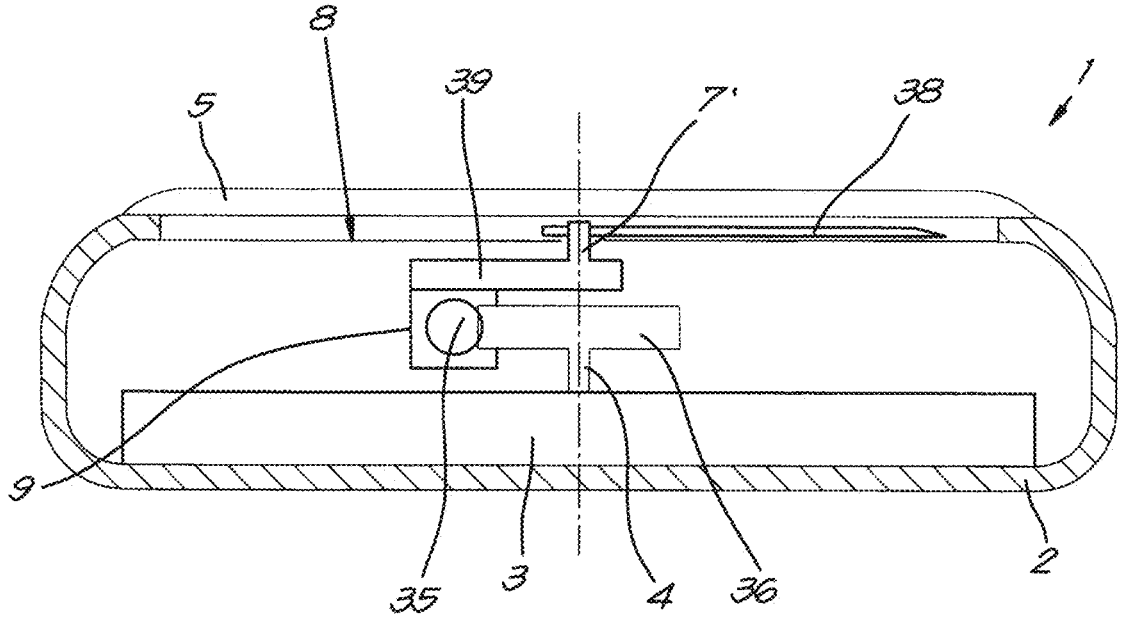
FIG. 10 shows another variant of a hybrid clockwork according to the invention.

FIG. 10 shows a simpler embodiment of a serial hybrid clockwork according to the invention.

In this case it concerns a clockwork 1 with a conventional pointer 38 that is fastened to a spindle 7' that is rotatably affixed in the housing 2 of the clockwork 1 and which is provided with an arm 39 on which a motor 9 is fastened with a worm 35 on its spindle, whereby the worm 35 meshes with a worm wheel 36 that is fastened directly to the outgoing spindle 4 of the mechanical driving gear 3.

If the motor 9 is not controlled, then the pointer 38 turns at the same speed as the outgoing spindle 4 of the mechanical driving gear 3. If the motor is driven, then the rotation of the pointer 38 can be accelerated or decelerated according to the direction of rotation in which the motor 9 is driven. The worm-worm wheel 35-36 transmission is of a permanent nature.

It is clear that in all cases the additional driving gear 8 can be implemented in different ways, for example by means of a linear motor or similar, whether electrical or mechanical.

The differential can also be realised in other ways.

A combination of serial and parallel controls is not excluded.

The internal or external signal for controlling the controller 22 can be an analogue or digital signal, whereby an external mechanical operation, by pushing in or pulling out a crown wheel, does not belong to the objectives of the invention.

The present invention is by no means limited to the embodiments described as an example and shown in the drawings, but a hybrid clockwork according to the invention can be realised in all kinds of forms and dimensions without departing from the scope of the invention.

The invention claimed is:

1. Pointer module driven by a mechanical driving gear, with an additional driving gear (8) to drive the pointer module (5) in parallel or in series with the mechanical driving gear (3) to set the pointers of a mechanical clockwork, the pointer module being installable in an existing mechanical clockwork as an add-on or plug-in in order to provide the mechanical clockwork with the precision and automatic adjustment of a quartz clock or of an atomic clock, for which use is made either of an external signal of an atomic clock or of an internal signal of a built-in quartz clock with a program of the correct time, and because the pointer module measures the position of the pointers continuously, the pointer module will set the pointers on the programmed or desired hour, and wherein between the pointer module and one outgoing spindle (4) of the mechanical driving gear (3) of the mechanical clockwork in which it is placed, a differential (6) is present that is driven by the outgoing spindle (4) of the mechanical driving gear (3) and which is provided with an outgoing spindle (7) for the drive of the pointer module (5), whereby the differential (6) is also permanently coupled to the additional drive (8) of which a motor (9) is fastened in the housing (2) of the mechanical clockwork (1) for controlling the outgoing spindle (7) of the differential (6).

2. Pointer module according to claim 1, wherein the pointer module provides the adjustment function of the crown of the mechanical clockwork, so that no external mechanical operation is needed to set the mechanical clockwork.

3. Pointer module according to claim 2, wherein the pointer module is placed in a clockwork (1) that is provided with a receiver (25) for receiving external wireless or other signals.

4. Pointer module according to claim 1, wherein the pointer module automatically adapts to the transition from summertime to wintertime or adjusts the time when travelling from one time zone to another or adjusts the date at the end of a month that does not have 31 days, and automatically resets the time shown by the mechanical clockwork after the clockwork has stopped for lack of winding reserve when it is again set in operation by rewinding it.

5. Pointer module according to claim 1, wherein the additional driving gear (8) is provided with an internal clock (23) whose signal is coupled to a controller (22).

6. Pointer module according to claim 1, wherein the pointer module is placed in a clockwork (1) that is provided with a receiver (25) for receiving external wireless or other signals.

7. Pointer module according to claim 6, wherein that the external wireless signals relate to the time data from an external clock (23').

8. Pointer module according to claim 7, wherein the clockwork (1) in which it is placed is provided with an electrical or electronic controller (22) with an algorithm that continuously or periodically records and compares the indicated time with the time data received from an internal clock (23) and/or an external clock (23') and, if there is a time difference, adjusts the indicated time by driving the additional driving gear (8) in the one or the other direction to make the indicated time correspond to the received time data.

9. Pointer module according to claim 6, wherein the clockwork in which it is placed is provided with a receiver (25) in the form of a transparent touchscreen (37) to adjust the indicated time by touch movements via the controller (22) of the additional driving gear (8).

10. Pointer module according to claim 1, wherein the differential (6) is formed by two coaxial planetary gear transmissions, respectively a first gear transmission (13*a*) and a second gear transmission (13*b*), each composed of a sun gear (14), a coaxial crown wheel (15) and one or more satellites (16) meshing there between that are rotatably mounted on bearings on a satellite support (17), whereby the crown wheel (15) is common to both planetary gear transmissions (13*a*,13*b*).

11. Pointer module according to claim 10, wherein the first gear transmission (13*a*) is formed by both a satellite support (17*a*) that is permanently connected to the housing (2) of the clockwork (1), whereby the satellite support (17*a*) is also a support of the common crown wheel (15) that is freely rotatably mounted on bearings, as well as by a sun gear (14*a*) that is drivingly coupled to the outgoing spindle (4) of the mechanical driving gear (3).

12. Pointer module according to claim 10, wherein the second gear transmission (13*b*) is formed by a satellite support (17*b*) that is coaxially rotatably affixed in the housing (2) with respect to the outgoing spindle (4), whereby the sun gear (11*b*) is drivingly coupled to the outgoing spindle (7) of the differential (6) for driving the pointers or the pointer module (5) and whereby the satellite support (17*b*) can be driven in rotation by the aforementioned additional driving gear (8).

13. Clockwork according to claim 1, wherein the mechanical driving gear (3) has a number of outgoing spindles (4) for driving the pointers or the pointer module (5) and that a differential (6) and an additional drive (8) are provided for at least each of a number of these outgoing spindles (4).

14. Pointer module according to claim 1, wherein the pointer module is placed in a clockwork (1) with a mechanical driving gear (3) with only one single outgoing spindle (4) and a pointer (38) on a rotating spindle or a pointer module (5) with a rotating pointer plate (28), whereby the pointer (38) or pointer plate (28) is driven by the outgoing spindle (4) of the mechanical driving gear (3), whereby the additional driving gear (8) is provided between the outgoing spindle (4) of the mechanical driving gear (3) and the rotating pointer (38) or pointer plate (28).

15. Pointer module driven by a mechanical driving gear with an additional driving gear (8) to drive the pointer module (5) in parallel or in series with the mechanical driving gear (3) to set the pointers of a clockwork, the pointer module being installable in a mechanical clockwork as an add-on or plug-in in order to provide the mechanical clockwork with the precision and automatic adjustment of a quartz clock or of an atomic clock, for which use is made either of an external signal of an atomic clock or of an internal signal of a built-in quartz clock with a program of the correct time, and because the pointer module measures the position of the pointers continuously, the pointer module will set the pointers on the programmed or desired hour, wherein the pointer module is placed in a clockwork (1) with the mechanical driving gear (3) with only one single outgoing spindle (4) and a pointer (38) on a rotating spindle or the pointer module (5) with a rotating pointer plate (28), whereby the pointer (38) or pointer plate (28) is driven by the outgoing spindle (4) of the mechanical driving gear (3), whereby the additional driving gear (8) is provided between the outgoing spindle (4) of the mechanical driving gear (3) and the rotating pointer (38) or pointer plate (28) and wherein the additional driving gear (8) is provided with an electric motor (9), whereby the electric motor (9) is fastened to the rotating pointer (38) or pointer plate (28) and is coupled to the outgoing spindle (4) of the mechanical driving gear (3) in a torque-transferring way to be able to make the rotating pointer (38) or pointer plate (28) rotate around the outgoing spindle (4).

16. Pointer module according to claim 15, wherein the electric motor (9) of the additional driving gear (8) is coupled to the rotating pointer (38) or pointer plate (28) in a torque transferring way by means of a worm (35) on the shaft of the electric motor (9) and a worm wheel (36) meshing therewith fastened to the outgoing spindle (3) of the mechanical driving gear (3).

17. Pointer module according to claim 15, wherein the electric motor (9) on the rotating pointer (38) or pointer plate (28) is connected to an electric supply that is joint with the housing (2) via slip rings on the outgoing spindle (4) of the mechanical driving gear (3).

18. Pointer module according to claim 16, wherein, if the additional driving gear (8) is not driven, then the minute disk (28) turns jointly and synchronously with the outgoing spindle (4) of the mechanical driving gear so that in this case the situation is the same as when the minute disk (28) is driven directly by the mechanical driving gear (3).

19. Pointer module according to claim 16, wherein, when the indicated time is ahead or behind the actual time, then the clockwork (1) can be adjusted by driving the worm (35) with the motor (9) in the one or the other direction, such that the minute disk (28) can be turned with respect to the outgoing spindle (4) to correct the indicated time, whereby in this case the mechanical driving gear (3) and the additional driving gear (8) engage in series.

* * * * *